United States Patent [19]

Kazuta et al.

[11] 4,434,755

[45] Mar. 6, 1984

[54] MOTORCYCLE WITH CLOSEABLE ENGINE INTAKE AND EXHAUST PASSAGES

[75] Inventors: Hisashi Kazuta, Iwata; Yasunari Kawai, Hamamatsu; Naoki Tsuchida, Iwata, all of Japan

[73] Assignee: Yamaha Hatsudoki Kabushiki Kaisha, Iwata, Japan

[21] Appl. No.: 331,634

[22] Filed: Dec. 17, 1981

[30] Foreign Application Priority Data

Dec. 26, 1980 [JP] Japan ..... 55-189084

[51] Int. Cl.[3] ..... F02B 77/00

[52] U.S. Cl. ..... 123/195 C; 123/198 E; 180/89.2

[58] Field of Search ..... 123/198 E, 195 C, 79 R, 123/323; 180/289, 84, 89.2, 309, 54 A, 225

[56] References Cited

U.S. PATENT DOCUMENTS

| | | | |
|---|---|---|---|
| 3,424,139 | 1/1969 | Brooks | 123/79 R |
| 4,075,986 | 2/1978 | Keck | 123/79 R |
| 4,143,731 | 3/1979 | Haustein | 180/89.2 |
| 4,175,630 | 11/1979 | Fleisher et al. | 180/225 |
| 4,215,665 | 8/1980 | Stambaugh | 123/195 C |
| 4,300,496 | 11/1981 | Price | 123/198 E |
| 4,338,890 | 7/1982 | Shelby et al. | 123/198 E |
| 4,354,464 | 10/1982 | Fujita | 123/323 |

*Primary Examiner*—Ira S. Lazarus

*Attorney, Agent, or Firm*—Ernest A. Beutler

[57] ABSTRACT

An intake and exhaust system for a compact motorcycle including a valve arrangement for closing both the intake and exhaust systems so as to preclude the escape of fuel vapors to the surrounding area when the motorcycle is not in use.

6 Claims, 6 Drawing Figures

MOTORCYCLE WITH CLOSEABLE ENGINE INTAKE AND EXHAUST PASSAGES

BACKGROUND OF THE INVENTION

This invention relates to an improved induction and exhaust system for a motorcycle and more particularly to an arrangement for closing the intake and exhaust passages of a motorcycle for storage.

Recently it has been proposed to provide a relatively small or compactable motorcycle that can be conveniently stored in the trunk of an automobile for transportation to a point where it will be used, or in a relatively compact storage area such as in the entryway to a home or the like. When a motorcycle is so stored, it is desirable to provide some means for assuring that the fuel or fuel vapors from the engine do not escape into the area where the motorcycle is stored. This is particularly important when the motorcycle is stored in a poorly ventilated area such as the trunk of an automobile.

It is, therefore, a principal object of this invention to provide an improved system for preventing the leakage of fuel vapors from a motorcycle.

It is yet a further object of this invention to provide an improved and simplified arrangement for sealing the intake and exhaust systems of an engine.

SUMMARY OF THE INVENTION

This invention is adapted to be embodied in a motorcycle or the like that has an internal combustion engine, an induction system for the engine having an inlet and an exhaust system for the engine having an outlet. In accordance with the invention, valve means are provided contiguous to the inlet and outlet for closing the induction system and the exhaust system from communicating with the atmosphere.

DETAILED DESCRIPTION OF THE PREFERRED EMBODIMENT

Figure 1:
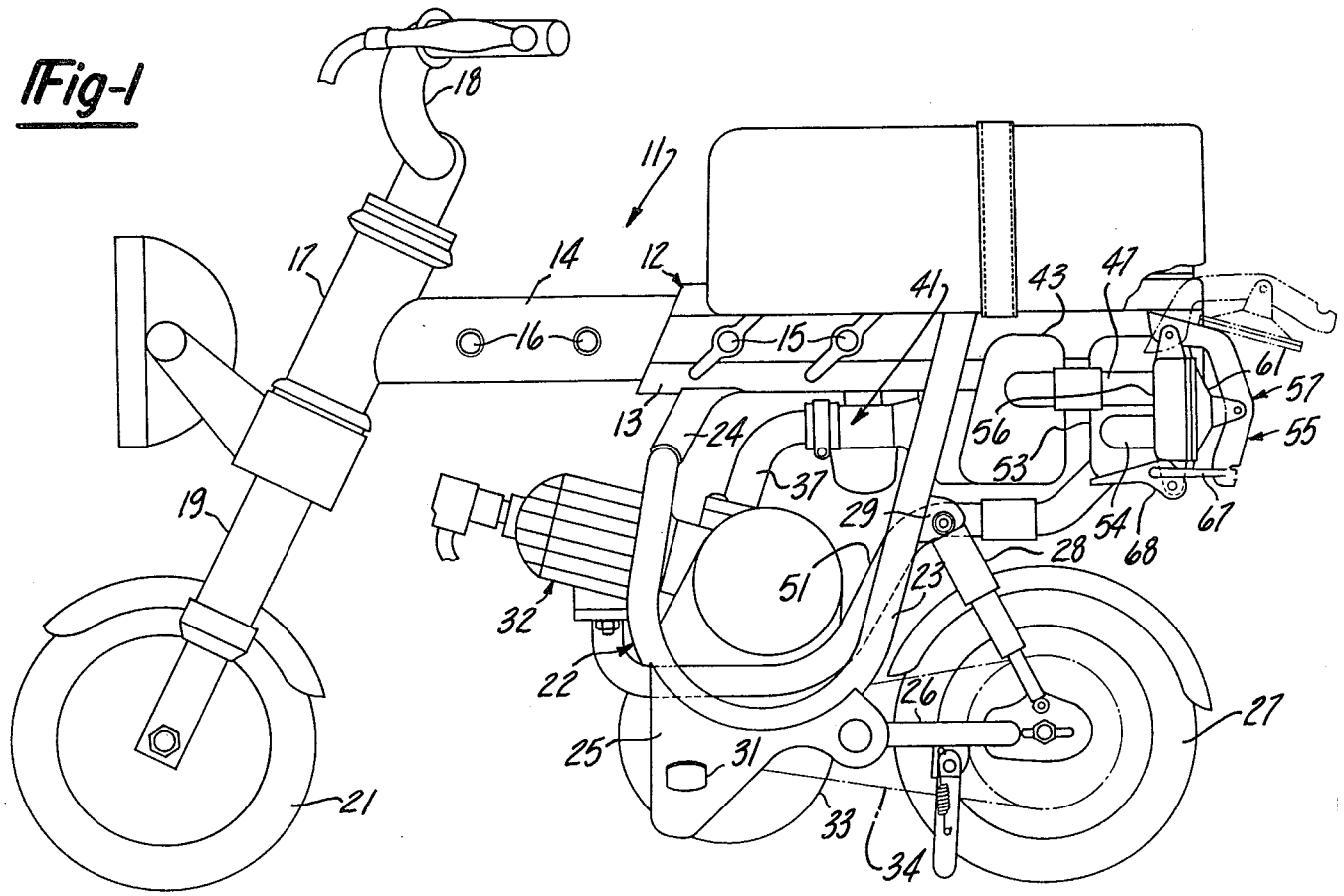
FIG. 1 is a side elevational view of an motorcycle constructed in accordance with this invention.

In the drawings the reference numeral 11 indicates generally a compactable motorcycle construction in accordance with this invention. The motorcycle 11 is constructed so that it may be compacted into a relatively small package so that it can be stored in confined areas such as the trunk of an automobile of the entryway to a house. Although the description relates to a collapsible type of motorcycle, it should be readily apparent to those skilled in the art that the invention may also be used in conjunction with any small motorcycle that is capable of being so stored.

The motorcycle 11 includes a main frame tube assembly, indicated generally by the reference numeral 12, and consisting of an outer tube 13 and an inner tube 14. The inner and outer tubes 13 and 14 are telescopic relative to each other and are held in their extended position by means of through bolts 15 that pass through aligned apertures in the outer tube 13 and the inner tube 14. The inner tube 14 is provided with a second pair of holes 16 that will be aligned with the outer tube holes when the inner tube 14 is telescoped into the outer tube 13. The through bolts 15 may also be used to maintain the motorcycle 11 in this collapsed condition. As will be noted, the main tube assembly 12 is generally horizontally disposed so as to facilitate this collapsing movement. A head pipe 17 is affixed to the forward end of the inner tube 16. A handlebar assembly 18 and front forks 19 are journaled by the head pipe 17 in a known manner. A front wheel 21 is carried by the front forks 19.

A down tube assembly, indicated generally by the reference numeral 22, is also provided. The down tube assembly 22 consists of a generally saddle-shaped piece having portions 23 disposed on opposite sides of the main tube assembly 12. A forwardmost crosspiece of the down tube assembly 22 is affixed to a bracket 24 that is carried by the underside of the forwardmost portion of the outer tube 13. A crosspiece at the rear side of the down tube assembly 22 is disposed above the center of the outer tube 13 and is affixed to it in any suitable manner.

A pair of brackets 25 are affixed to the down tube portions 23 and provide a pivotal support for the forward end of a respective trailing arm 26. The trailing arm 26 rotatably supports a rear wheel 27. A combined shock absorber and spring assembly 28 is position at each side of the motorcycle 11 and is connected between the respective trailing arm 26 and a bracket 29 that is affixed to the upstanding portion of each down tube portion 23 so as to provide the suspension for the rear wheel 27.

A pair of foldable footrests 31 are also carried by each of the brackets 25 so that the operator may rest his feet thereupon.

An engine, indicated generally by the reference numeral 32, is supported by the frame between the down tube portions 23. In the illustrated embodiment the engine 32 is of the single cylinder, two cycle type and is disposed with its cylinder bore inclined as a slight angle to the horizontal. The engine 32 has its output shaft coupled to a continuously variable transmission 33 which, in turn, drives the rear wheel 27 by means of a chain 34.

Figure 2:
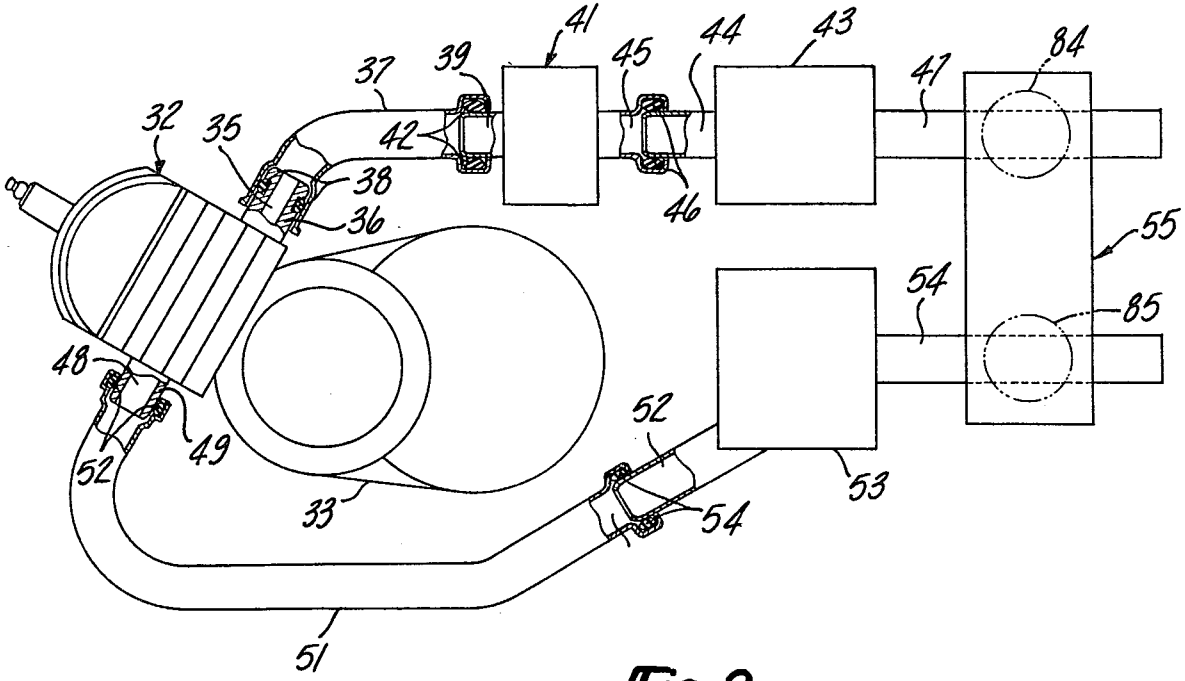
FIG. 2 is a partially schematic view showing the engine of the motorcycle and its induction and exhaust systems.

As seen in more detail in FIG. 2, the engine 32 has formed with an intake passage 35 that is formed in an inlet pipe 36. A delivery pipe 37 is sealing engaged with the pipe 36 by means of suitable hermetic seals 38. The opposite end of the delivery pipe 37 is sealing engaged with an outlet 39 of a carburetor, indicated generally at 41, by means of a further hermetic seal 42. The carburetor 41 in turn receives an air charge from an air cleaner assembly, shown schematically and indicated by the reference numeral 43. The air cleaner 43 has an outlet pipe 44 that is sealed to an inlet 45 of the carburetor 41 by means of a suitable hermetic seal 46. The air cleaner 43, in turn, has an inlet tube portion 47 that is positioned to the rear of the main tube assembly 22 at the uppermost portion of the motorcycle.

The engine 32 also includes an exhaust system including an exhaust passage 48 that is formed in an exhaust nipple 49. An exhaust pipe 51 has a hermetic seal 52 that provides a seal between its inlet and the exhaust nipple 49. The exhaust pipe 51 its discharge end sealingly engaged with an inlet 52 of a muffler 53 by means of a hermetic seal 54. The muffler 53 has its tail pipe 54 disposed adjacent the intake pipe 47 and in substantially parallel relationship to it.

Figure 3:
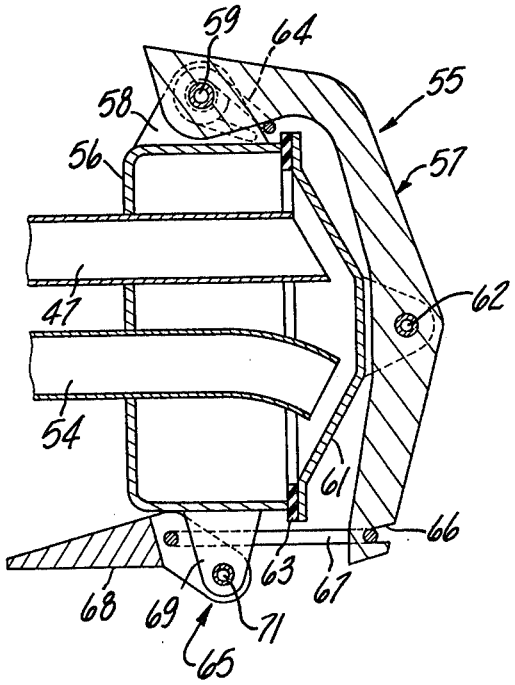
FIG. 3 is an enlarged cross-sectional view showing the shut-off system constructed in accordance with the invention.

A valving arrangement, indicated generally by the reference numeral 55 and shown in most detail in FIG. 3, is provided for simultaneously sealing off both of the inlet pipe and the tail pipe 54 from the atmosphere. By so sealing these pipes which are themselves sealed from the atmosphere, it is insured that no fumes can escape from the fuel system of the engine when it is stored.

The valving device 55 includes a cup-shaped casting 56 through which the pipes 47 and 54 extend. The pipes 47 and 54 terminate just outwardly of the open end of the cup-shaped housing 56. A valving element, indicated generally by the reference numeral 57, is pivotally supported by means of a pair of brackets 58 formed on one side of the housing 56 and a pivot pin 59. The valving element 57 carries a valve member 61 by means of a pivot pin 62. The valve member 61 has a peripheral portion that carries a seal 63 that is adapted to sealingly engage the open end of the cup shaped member 56 when in its closed position (FIG. 3).

The valving element 57 and valve member 51 carried thereby are normally urged toward an open position by means of a torsional spring 64 that encircles the pivot pin 59 and which bears against the housing 56 and valving element 57 so as to bias the valving element 57 and valve member 61 to an opened position wherein flow through the air cleaner inlet 47 and tail pipe outlet 54 is unobstructed.

The valve member 61 and valving element 57 are adapted to be maintained in a closed position when the motorcycle 11 is stored by means of a latching mechanism, indicated generally by the reference numeral 65. The latching mechanism includes a notch 66 formed in the outer end of the valving element 57 and which is adapted to be engaged by a U-shaped retainer 67. The retainer 67 is pivotally connected to an operating lever 68 which is, in turn, supported on the housing 56 by means of a bracket 69 and pivot pin 71. The latching assembly 65 is shown in its latched position in FIG. 3. To release the latch 65, the lever 68 is pivoted in a counterclockwise direction around the pivot pin 71 so as to bring the end of the link 67 over center and clear of the notch 66. The spring 64 will then urge the valving element 57 and valve member 61 to their open position. This open position is shown in the dot-dash view of FIG. 1.

Figure 5:
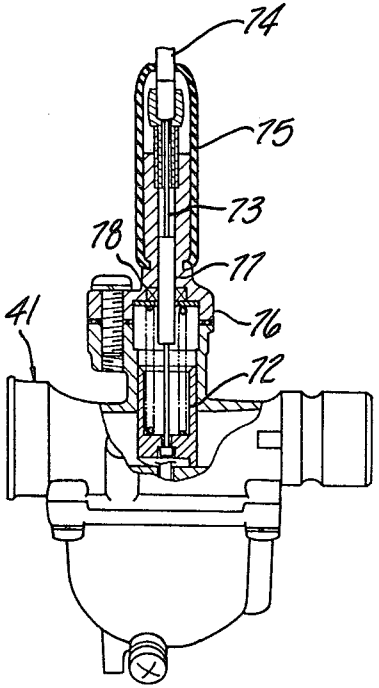
FIG. 5 is a side elevational view, in part similar to FIG. 4, with a portion broken away to show the throttle actuating mechanism.
Figure 6:
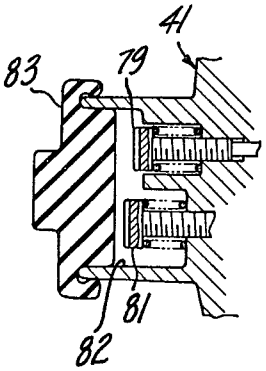
FIG. 6 is an enlarged cross-sectional view taken along the line 6—6 of FIG. 4.
Figure 4:
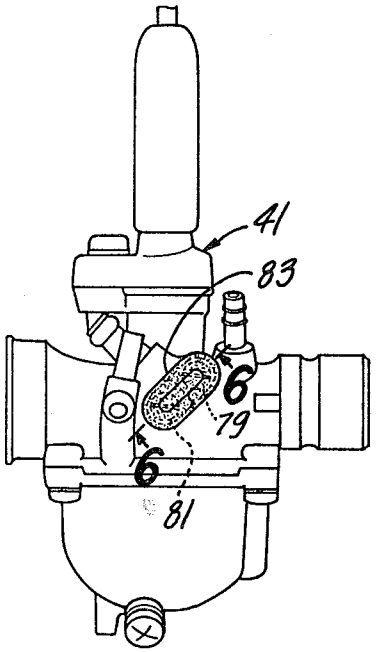
FIG. 4 is a side elevational view of the carburetor associated with the motorcycle engine.

In addition to providing the seals for the ends of the air cleaner inlet pipe 47 and tail pipe 54, the carburetor 41 is itself sealed so as to prevent the escape of gasoline fumes when being stored. This arrangement may be best seen in FIGS. 4 through 6.

The carburetor 41 is of the sliding piston type and has a piston valve 72 that is operated by means of a flexible transmittor 73. The transmittor 73 is in turn supported within a protective sheath 74. A flexible boot, formed from rubber of the like, 75 surrounds the sheath 74 and is sealingly engaged to the sheath and to an extension 76 of the carburetor which surrounds the wire 73. The wire 73, in turn, is affixed to an operating plunger 77 which is sealingly engaged by a seal 78 carried by the projection 76.

The carburetor is also provided with a throttle adjusting screw 79 and an idle screw 81, both of which are accessible through a recess 82 formed in the body of the carburetor. An elastomeric seal 83 is fitted around the body of the carburetor to close the projection 82 and seal the screws 79 and 81.

With the construction of the embodiment described the valve 55 is effective to close off both the inlet end of the air cleaner intake pipe 47 and the outlet end of the tail pipe 54 simultaneously. When these ends are closed, the fuel system associated with the engine 32 is effectively sealed from the atmosphere and the motorcycle 11 may be stored in any area which is poorly ventilated, such as the trunk of an automobile, without significant danger.

Instead of employing a single valve for closing both the inlet end of the intake pipe 47 and the outlet end of the tail pipe 54, separate valves of any known type may be provided for closing both of these pipes. In FIG. 2 two such separate valves are shown schematically in phantom and are identified by the reference numerals 84 and 85. The valve 84 closes off the intake pipe 47, and the valve 85 closes off the tail pipe 54. With such an arrangement the intake pipe 47 and tail pipe 54 need not be disposed closely adjacent each other. In addition to this variation, other modifications may be made without departing from the spirit and scope of the invention, as defined by the appended claims.

We claim:

1. In a motorcycle or the like having an internal combustion engine having a combustion chamber, an induction system for said engine having a charge forming device for delivering a fuel air charge to said combustion chamber and an air inlet upstream of said charge forming device, and an exhaust system leading from said combustion chamber and terminating in an outlet that communicates with the atmosphere, the improvement comprising valve means contiguous to said inlet and said outlet for closing the communication of said induction system and said exhaust system with the atmosphere.

2. A motorcycle as set forth in claim 1 wherein the exhaust system outlet and the induction system inlet are juxtaposed to each other.

3. A motorcycle as set forth in claim 2 wherein the valve means operates to close the inlet and the outlet simultaneously.

4. A motorcycle as set forth in claim 3 wherein a single valve element closes both the inlet and the outlet.

5. A motorcycle as set forth in claim 4 wherein the inlet and the outlet are formed by adjacent pipes terminating within a cup-shaped element having its open end disposed adjacent said inlet and said outlet, the single valving element being cooperative with the open end of said cup-shaped element for closing said cup-shaped element.

6. A motorcycle as set forth in claim 5 wherein the inlet system extends along one side of the engine and the exhaust system extends along the other side of the engine.

* * * * *